US005337493A

United States Patent [19]

Hill

[11] Patent Number: 5,337,493

[45] Date of Patent: Aug. 16, 1994

[54] SHOE WITH A TONGUE EXTENDING FROM A LINER

[75] Inventor: David I. Hill, Taichung Hsien, Taiwan

[73] Assignee: K-Swiss Inc., Chatsworth, Calif.

[21] Appl. No.: 907,775

[22] Filed: Jun. 30, 1992

Related U.S. Application Data

[63] Continuation-in-part of Ser. No. 712,926, Jun. 7, 1991, abandoned.

[51] Int. Cl.[5] ..... A43B 23/26

[52] U.S. Cl. ..... 36/54; 36/114; 36/55

[58] Field of Search ..... 36/50.1, 51, 54, 58.5, 36/55, 114, 140

[56] References Cited

U.S. PATENT DOCUMENTS

| | | | |
|---|---|---|---|
| 660,284 | 10/1900 | Webber | 36/54 |
| 1,028,598 | 6/1912 | Papp | 36/54 |
| 1,691,219 | 11/1928 | Winn | 36/51 |
| 2,244,030 | 6/1941 | Teechan | 36/55 |
| 2,304,261 | 12/1942 | Louch | 36/55 |
| 2,428,262 | 9/1947 | Bunker | 36/51 |
| 4,373,275 | 2/1983 | Lydiard | 36/54 |
| 5,024,006 | 6/1991 | Kiyosawa | 36/54 |

FOREIGN PATENT DOCUMENTS

| | | | |
|---|---|---|---|
| 0148296 | 1/1937 | Fed. Rep. of Germany | 36/54 |
| 1211047 | 3/1960 | France | 36/58.5 |
| 1321468 | 12/1963 | France | 36/58.5 |
| 251105 | 7/1948 | Switzerland | 36/54 |

*Primary Examiner*—Paul T. Sewell
*Assistant Examiner*—Thomas P. Hilliard
*Attorney, Agent, or Firm*—Drucker & Sommers

[57] ABSTRACT

This disclosure is directed to a novel shoe tongue construction wherein the tongue is made as an integral extension of preferably the heel portion of the shoe. The tongue may also be an integral extension of the quarter. The tongue construction provides greater comfort to the wearer of the shoe than do conventionally mounted tongue constructions because the tongue is integrally formed with either the counter or the quarter of the shoe rather than being stitched only to the vamp. This construction is also more economical to make because cutting and stitching requirements are reduced.

16 Claims, 6 Drawing Sheets

Fig. 9
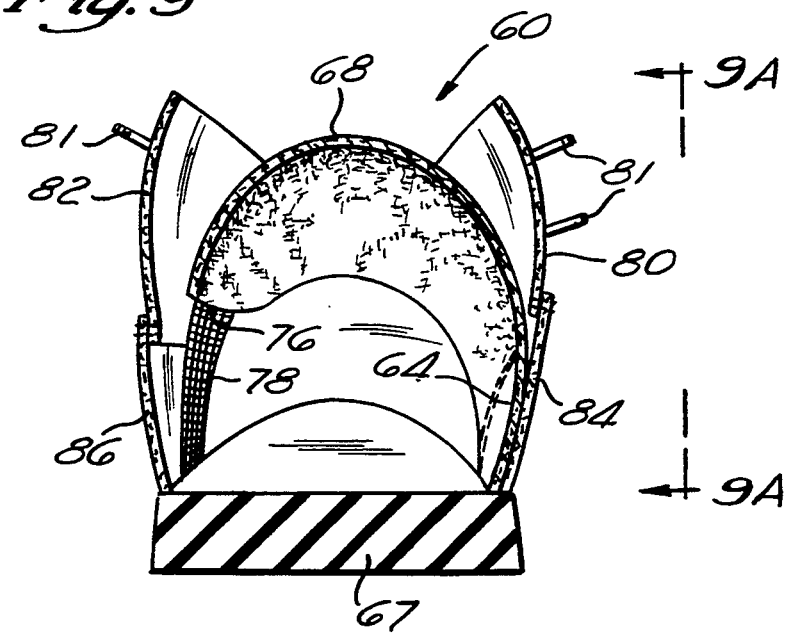
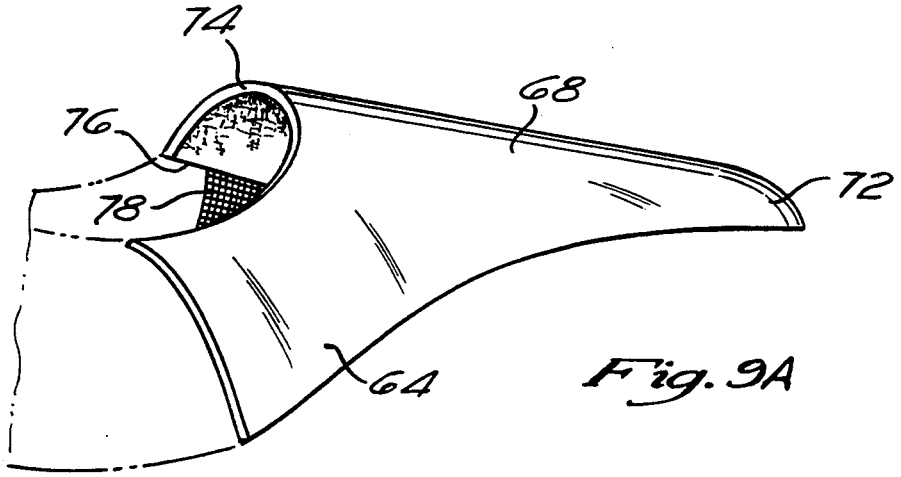
Fig. 9A

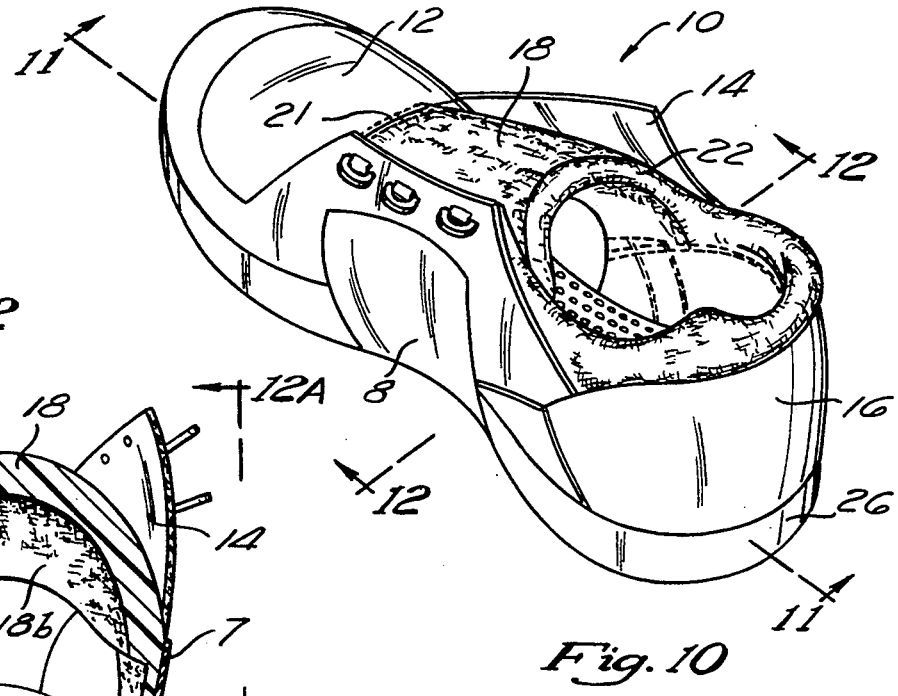
Fig. 10
Fig. 12
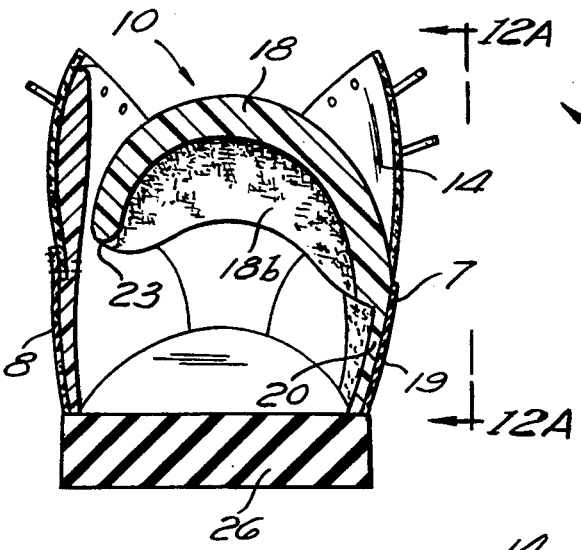
Fig. 11
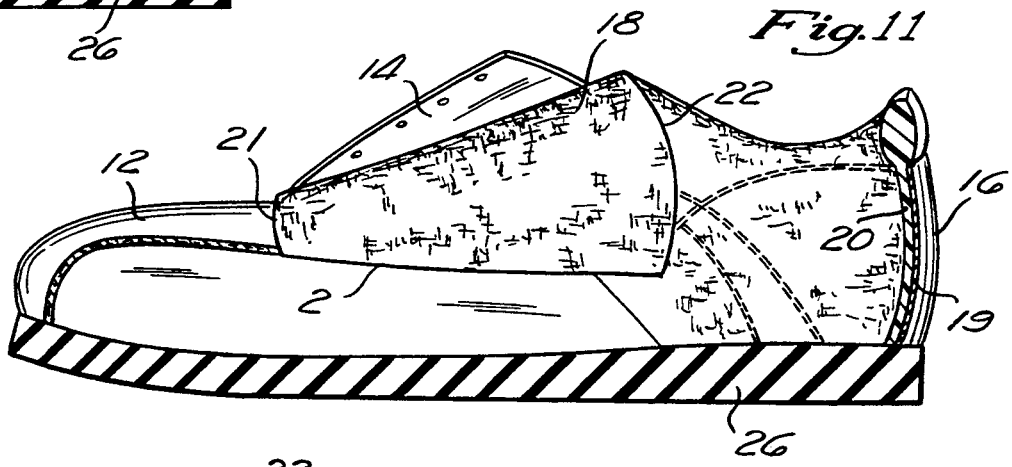
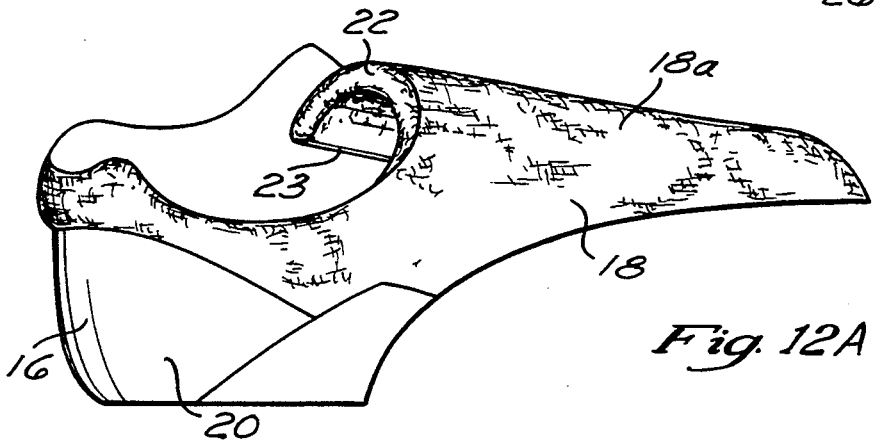
Fig. 12A

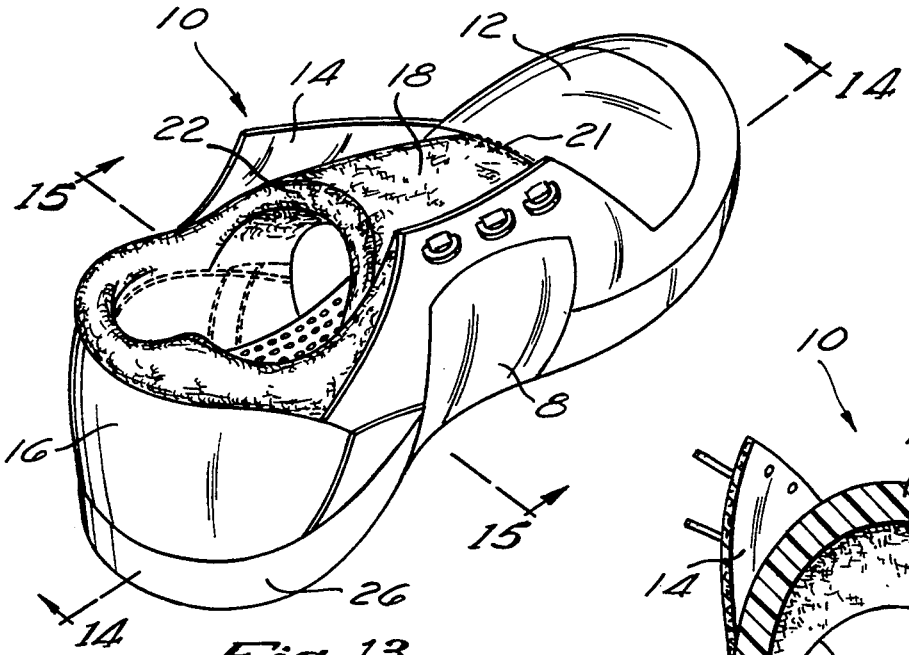
Fig. 13
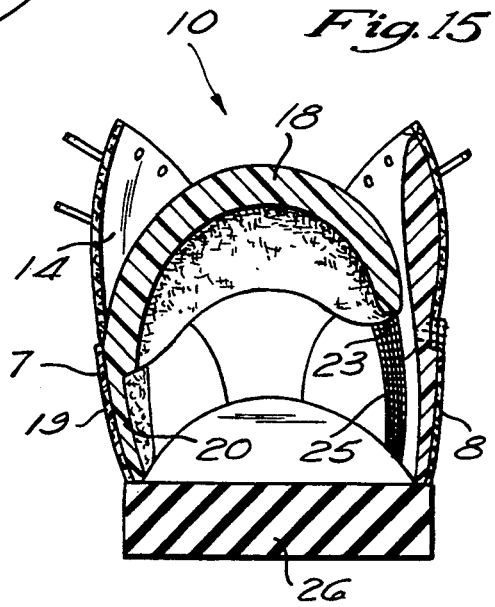
Fig. 15
Fig. 14
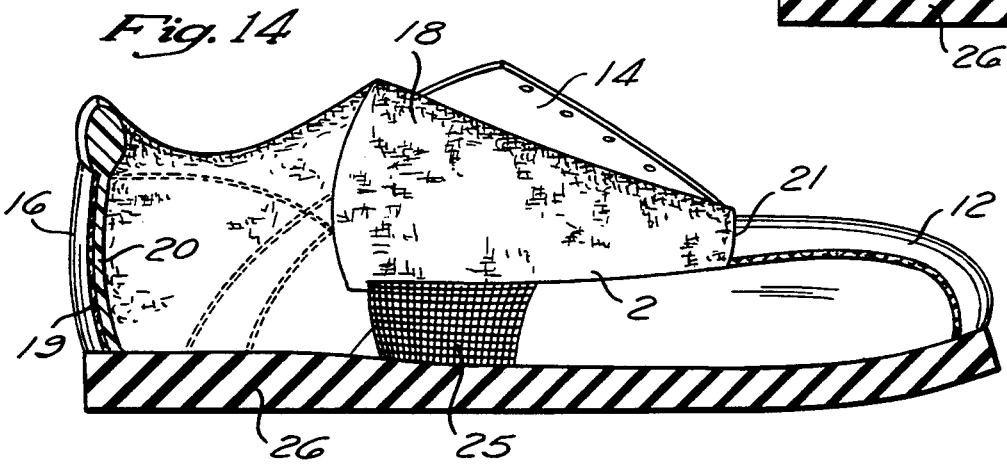
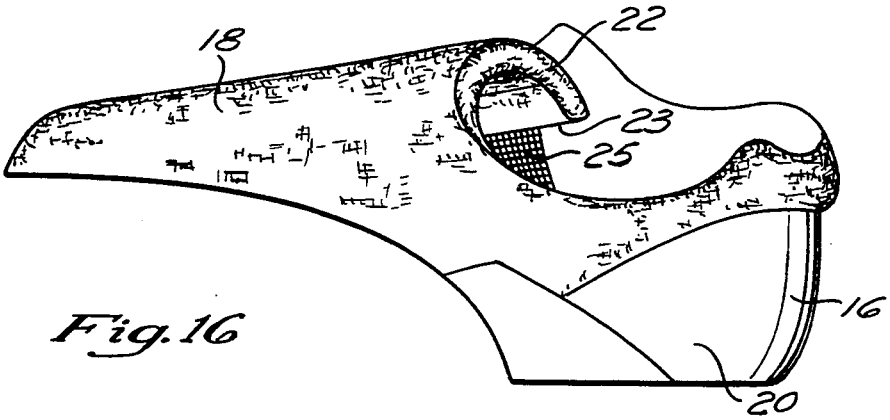
Fig. 16

SHOE WITH A TONGUE EXTENDING FROM A LINER

CROSS REFERENCE TO RELATED APPLICATIONS

This application is a continuation-in-part of application Ser. No. 07/712,926, filed Jun. 7, 1991, now abandoned.

BACKGROUND OF THE INVENTION

1. Field of the Invention

This invention relates to the field of footwear, more particularly footwear having a tongue portion.

2. Description of the Prior Art

There is disclosed in the prior art shoes which have a tongue portion made unitary with other sections of the shoe. For example, U.S. Pat. No. 1,691,219 to Winn discloses buckle overshoes wherein the tongue is a unitary extension of only the vamp portion of the shoe. U.S. Pat. No. 2,244,030 to Teehan discloses a shoe wherein the tongue is formed with the lining of one side of the shoe. However, since the tongue is unitary with the vamp, counter and quarter regions of the shoe, the tongue will have limited ability to best mold to the wearer's feet.

U.S. Pat. No. 2,428,262 to Bunker discloses a shoe very similar to the overshoe of Winn, except that two elasticized panels are provided at the leading edge of the tongue. Little if any molding of this tongue would be expected to result from the design of this shoe.

Shoes normally have a tongue portion stitched to, and underlying the front part of the shoe—the vamp. The tongue normally extends from the vamp under the lacing area of the shoe. The tongue is, initially, formed as a separate piece of material, and then is stitched to the vamp. There is thus a layering of material where the tongue is stitched to the vamp, and this can sometimes cause discomfort to the wearer. Also, because the tongue is only "hinged" at the frontal vamp portion, it can readily be displaced away from the lacing area.

It is a major objective of this invention to eliminate the cost of the cutting, and the stitching, of the tongue inherent in the prior art manufacturer of shoes, to eliminate accidental displacement of the shoe tongue, and to achieve a greater comfort level by having the tongue integrally formed with other parts of the shoe; namely, the quarter, counter, or quarter and counter region of the shoe.

BRIEF SUMMARY OF THE INVENTION

This invention is directed to a novel shoe tongue construction wherein the tongue is made as an integral extension of preferably the heel portion of the shoe—the heel portion of the shoe being known in the art as the counter. The tongue may also be an integral extension of the quarter. The quarter is the area in the mid-portion of the shoe, immediately adjacent to the lacing lines, this quarter area lying between the vamp and the counter.

Regardless of whether the tongue construction of this invention extends from the counter or the quarter, or from a portion of each such area, substantial stitching is avoided, and the tongue may be much more stably positioned in the shoe than if the tongue is attached only at the vamp section of the shoe.

The tongue extends only from one side of the counter or quarter thereby initially leaving a free unattached opposite edge. In the preferred embodiment, the initially free unattached edge of the tongue is anchored to the sole of the shoe by means of an elasticized strip of material. The tongue, while being stably positioned along the longitudinal axis of the shoe is still free to move up or down with respect to the shoe sole, along the longitudinal axis of the shoe.

The tongue construction thus provided provides greater comfort to the wearer of the shoe than do conventionally mounted tongue constructions because the tongue is integrally formed with either the counter or the quarter of the shoe rather than only being stitched to the vamp. This construction is also more economical to make because cutting and stitching requirements are reduced.

BRIEF DESCRIPTION OF THE FIGURES

This invention is described with reference to the following drawings:

FIG. 9 is a transverse cross-section taken along the line 8—8 of FIG. 8;

FIG. 9*a* shows the tongue construction of this invention as an extension of the quarter section, and is shown isolated from the shoe proper;

FIG. 10 is a top perspective view of a fourth embodiment of the novel tongue construction of this invention;

FIG. 11 is a longitudinal cross-section taken along the line 11—11 of FIG. 10;

FIG. 12 is a transverse cross-section taken along the line 12—12 of FIG. 10;

FIG. 12*a* shows the tongue construction of this invention as an extension of the heel counter lining, and is shown isolated from the shoe proper;

FIG. 13 is a side elevational view of a fifth embodiment of the novel tongue construction of this invention;

FIG. 14 is a longitudinal cross-section taken along the line 14—14 of FIG. 13;

FIG. 15 is a transverse cross-section taken along the line 15—15 of FIG. 13; and FIG. 16 shows the tongue construction of this invention as an extension of the heel outer lining, and is shown isolated from the shoe proper.

DETAILED DESCRIPTION OF THE INVENTION

Figure 1:
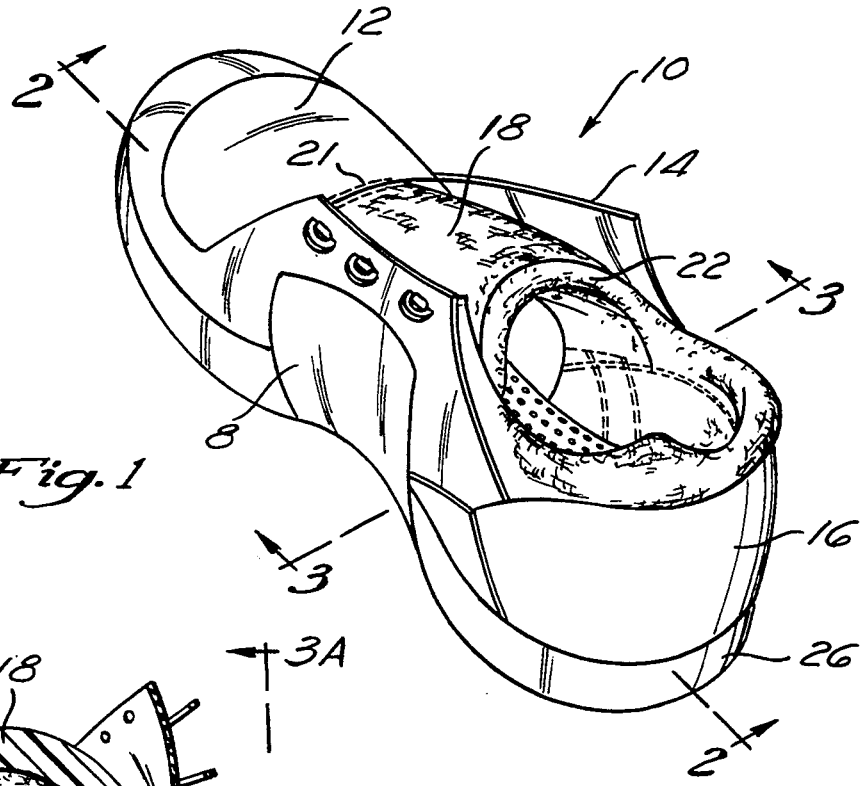
FIG. 1 is a top perspective view of a first embodiment of the novel tongue construction of this invention.

A right shoe 10 is shown in FIG. 1 typically having a vamp area 12, a quarter area 14 and a counter area 16. The vamp area 12 is that area directly in front of the lacing area of the shoe and normally overlies the toes of a foot. The quarter area 14 normally overlaps the mid-portion of the foot in front of the ankle. The counter 16 normally surrounds the heel of the foot. The outer side of the shoe 10 is designated, generally, by the numeral 7 and the inner side by the numeral 8. (See FIG. 3).

The counter 16 of the shoe is typically formed with an outer material, e.g. made of leather 19 and an inner soft, cushioned lining 20 of e.g. wool, DACRON® synthetic polyester fiber, or cotton. In the presently preferred embodiment of this invention, extending forwardly of the counter area 16 is a tongue 18.

Figure 3:
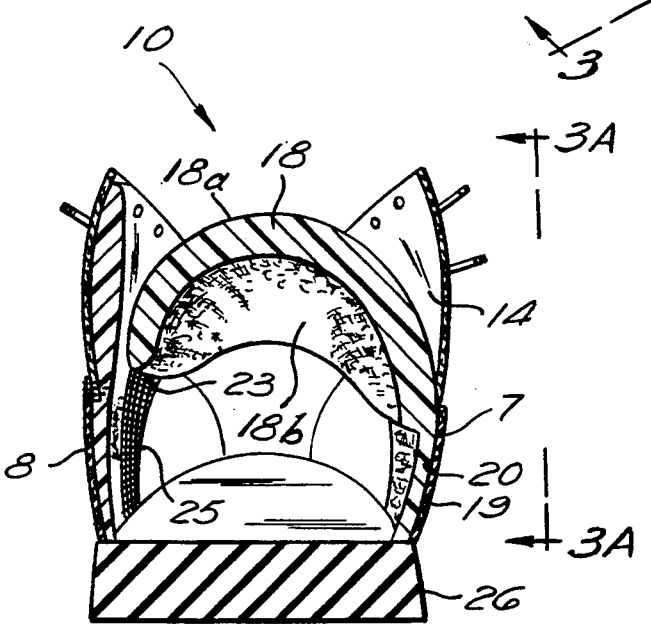
FIG. 3 is a transverse cross-section taken along the line 3—3 of FIG. 1.
Figure 3A:
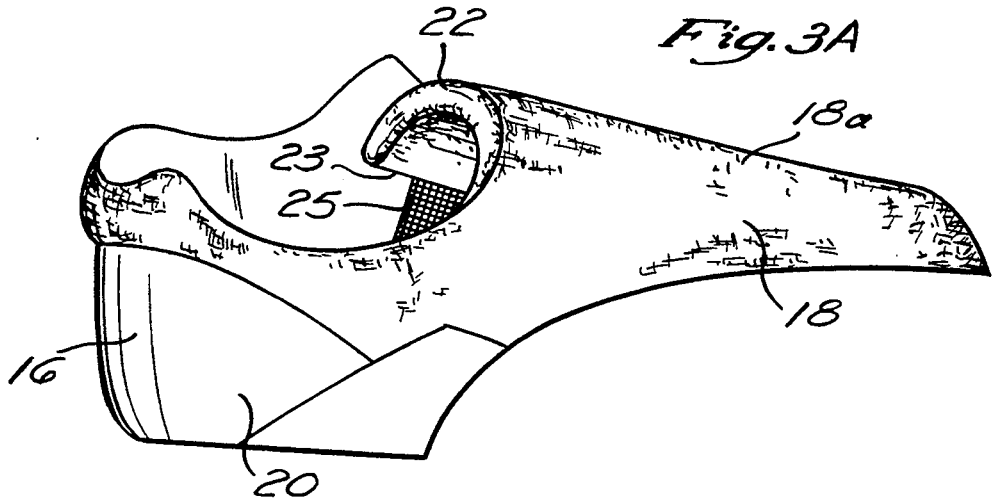
FIG. 3*a* shows the tongue construction of this invention as an extension of the heel counter lining, and is shown isolated from the shoe proper.

The tongue 18 is typically formed of an outer fabric cover material 18*a*, and a cushioned lining therefor 18*b*. The tongue 18 is an integral and/or unitary extension of the lining 20 of the heel counter, as best seen in FIGS. 3 and 3*a*. Thus, the tongue 18 extends forwardly of the heel counter area 16, and underlies the quarter section 14. The tongue 18 need not be stitched or otherwise attached at its leading edge 21, but can be stitched as its leading edge 21, if desired. The trailing edge of the tongue 22 lies just to the rear of the quarter section 14.

Figure 2:
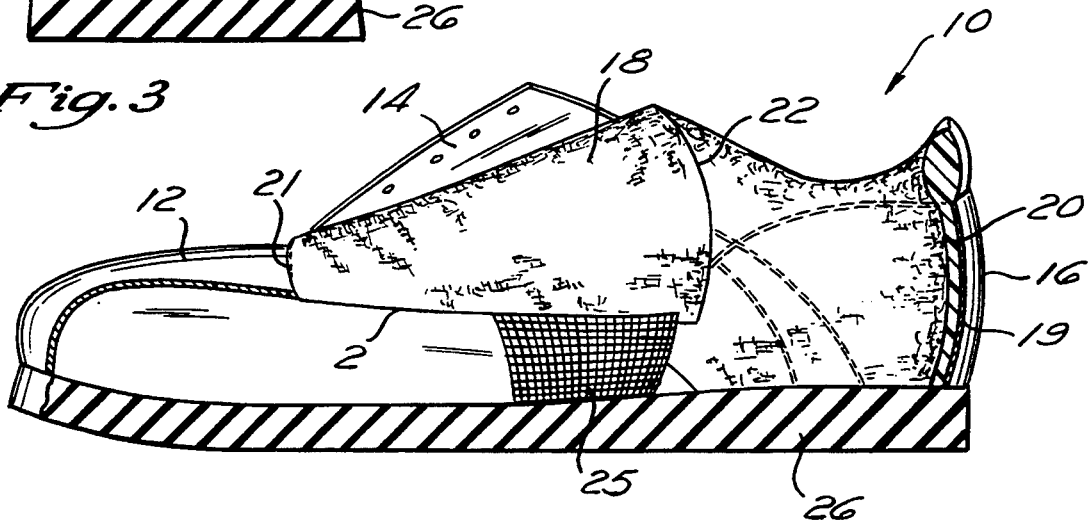
FIG. 2 is a longitudinal cross-section taken along the line 2—2 of FIG. 1.

The inner side or medial edge 23 of the tongue 18 (FIG. 2) is preferably flexibly anchored to the shoe 10 by means of an elasticized strip of fabric 25, attached to the sole 26 of the shoe in a conventional manner. Such construction permits the tongue 18 to be mounted stably along the longitudinal axis of the shoe, but still permits up-down movement along such axis.

An adjustable sleeve or channel is thus provided by the elasticized strip 25 and tongue 18 which extends integrally from the heel counter lining 20, as best seen in FIGS. 3 and 3*a*, through which the wearer's foot may easily pass.

When the tongue 18 is an integral extension of the heel counter lining 20, stitching normally required to affix the tongue to the vamp can be eliminated, if desired. At the same time, the comfort provided is superior to the normal tongue construction because of the integration of the tongue with the heel counter lining 20. Such construction enables the foot to be enveloped by the tongue construction resulting in more of a "glove fit," and without the layering of material necessarily required in stitching the tongue to the vamp in the normal tongue construction of the prior art.

While the construction shown in FIGS. 1–3A is presently preferred, the inner edge 23 of tongue 18 need not be anchored by strip 25. An embodiment wherein the inner edge 23 of the tongue 18 is not anchored by an elasticized strip 25 is illustrated in FIGS. 10–12*a* and is described further below.

Figure 4:
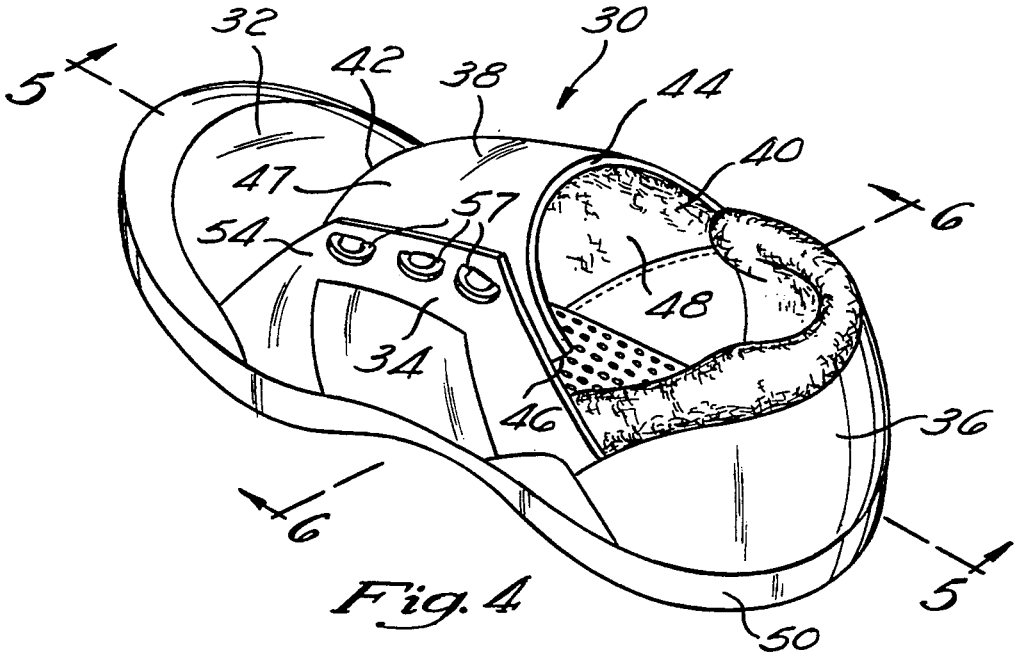
FIG. 4 is a top perspective view of a second embodiment of the novel tongue construction of this invention.
Figure 5:
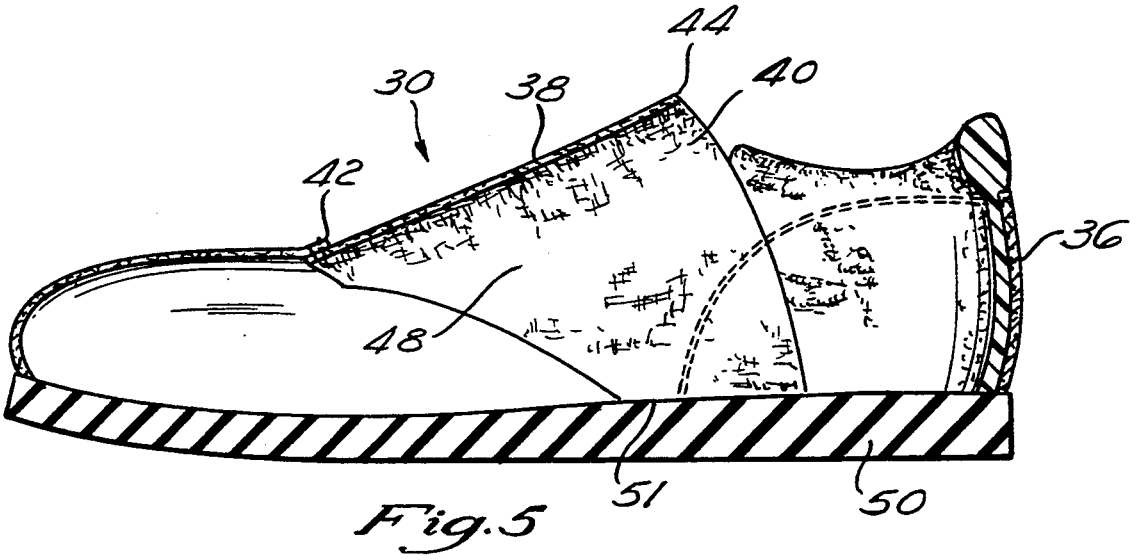
FIG. 5 is a longitudinal cross-section taken along the line 5—5 of FIG. 4.
Figure 6:
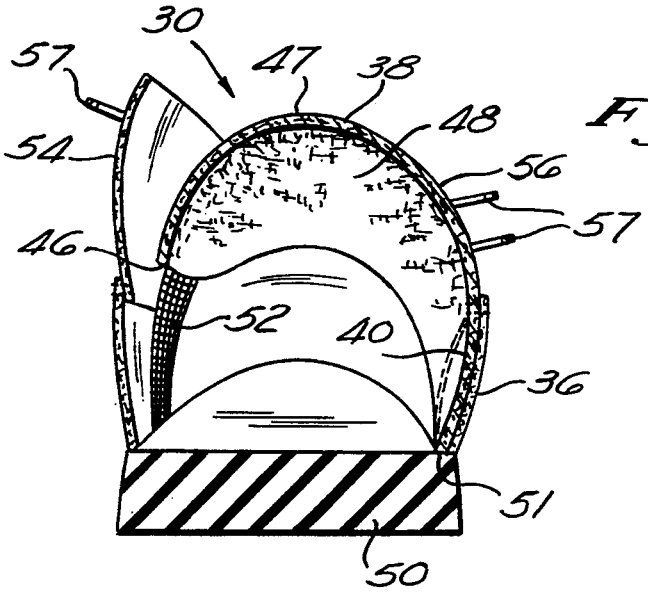
FIG. 6 is a transverse cross-section taken along the line 6—6 of FIG. 4.
Figure 7:
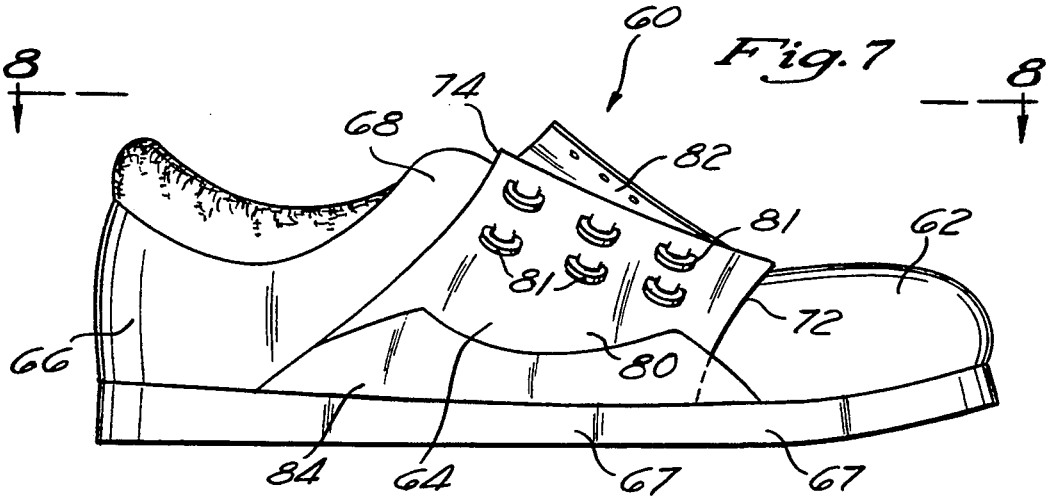
FIG. 7 is a side elevational view of a third embodiment of the novel tongue construction of this invention.
Figure 8:
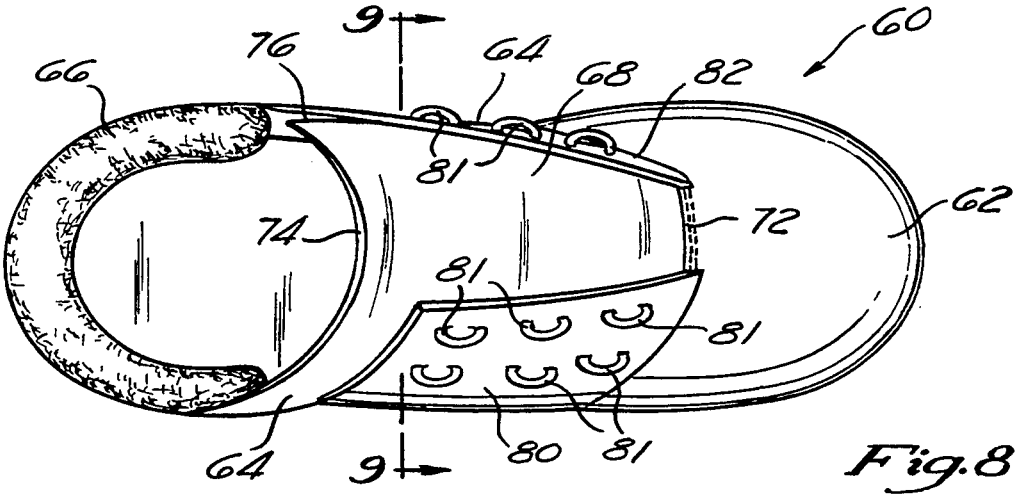
FIG. 8 is a top plan view of FIG. 7 taken along the line 8—8 of FIG. 7.

A second embodiment of this invention is shown in FIGS. 4–6. The shoe 30 has vamp, counter, and quarter sections 32, 34, 36, respectively. These sections of the shoe are as above described with reference to FIGS. 1–3. In this embodiment, the tongue section 38 is a unitary extension of section 40, the lower edge 51 of which is anchored to sole 50, by conventional means, section 40 being placed in an area occupied by both counter and quarter areas of the shoe. The tongue 38 has a free unattached leading edge 42, a trailing edge 44 and an inner side or medial edge 46. The tongue 38 is provided with a fabric or leather covering 47, and is normally lined with a cushioned material 48 made of cotton or synthetic material. The inner side edge 46 of tongue 38 is preferably flexibly anchored to the sole 50 by an elasticized fabric or mesh strip 52, strip 52 being affixed to inner edge 46 and affixed to the sole 50 in a conventional manner. Such construction provides a flexible channel through which the wearer's foot can pass—as best seen in FIG. 6.

Counter sections 54 and 56 carry lacing eyelets or D-rings 57 in a conventional manner.

A third embodiment of this invention is shown in FIGS. 7–9A. The shoe 60 has vamp, quarter, and counter sections 62, 64 and 66 respectively, all affixed to sole 67 by conventional means. In this embodiment, the tongue section 68 is a unitary extension of sole-anchored quarter section 64. The tongue section 68 has a free unattached forward edge 72, a rear trailing edge 74, and an inner side edge 76 (See FIGS. 9 and 9A). The inner side 76 may be flexibly anchored to the sole by elasticized strip 78 (see FIG. 9).

The lacing D-rings 81 are carried by upper quarter sections 80, 82, these upper sections (usually made of leather) overlying tongue 68. Upper sections 80, 82 are attached to lower support sections 84, 86 respectively, made usually of stiffer material than leather, sections 84, 86 being anchored to the sole 67 in a conventional manner.

FIGS. 10–12*a* show a fourth embodiment wherein no elasticized strip is used to anchor the inner edge 23 of the tongue to the junction of the uppers and the sole. For convenience and clarity of presentation, the same reference numerals used to describe FIGS. 1–3*a* are applied to describe the features of FIGS. 10–12*a*, except that no elasticized strip of fabric is used to anchor the inner side or medial edge 23 of the tongue to the junction of the uppers and the sole.

Although the shoe 10 is shown with its tongue 18 extending from the lateral side of the shoe, with its initially free edge 23 lying on the medial side of the shoe, the shoe can be constructed so that its tongue extends from the medial side of the shoe to the lateral side of the shoe. FIGS. 13–16 show a fifth embodiment of the shoe wherein the tongue 18 extends from the medial side of the heel counter, and its lateral edge is attached with an elasticized strip of fabric to the lateral edge of the shoe. This embodiment is identical in all other respects to the first embodiment of the shoe, which is depicted in FIGS. 1–3*a*, and whose reference numeral are applicable to FIGS. 13–16.

It should be borne in mind that the drawings are not rendered in actual scale so that certain features of the invention can be brought out and depicted.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims.

I claim:

1. A shoe comprising:

an outer shell portion having an exterior surface and an interior surface, said outer shell portion having a vamp section, a quarter section with a lacing area, and a counter section;

a sole attached to a lower portion of said outer shell portion; and a tongue portion which comprises an extension of a liner which at least partially lines the interior surface of said outer shell portion, said tongue portion having a leading edge which is overlapped by a portion of the vamp section, a trailing edge which lies nearer to the counter section, and medial and lateral side regions, wherein said tongue portion is continuous with and extends from said liner only at a rearward portion of one of its medial and lateral side regions;

said shoe tongue being rigidly affixed to the outer shell portion at one of the medial and lateral sides of the outer shell portions, and thereby being cantilevered to underlie the lacing area.

2. The shoe of claim 1, further comprising an elastic panel of material with an upper region and a lower region, said elastic panel of material being attached at its upper region to the other of the medial or lateral side of the tongue portion, which does not extend from said liner, said elastic panel of material being attached at its lower region in the vicinity of the sole.

3. The shoe of claim 1, wherein said leading edge of said tongue portion is attached to the vamp section.

4. A combined shoe tongue and shoe liner for use in a shoe, the shoe comprising an outer shell portion having an exterior surface and an interior surface, and a sole attached to a lower portion of said outer shell portion, said outer shell portion having a vamp section, a quarter section with a lacing area, and a counter section, said combined shoe tongue and shoe linear being shaped to fit inside the interior of said outer shell portion and including:

a liner section which is adapted to like at least a portion of the outside of the counter section of the outer shell portion; and a tongue section, said tongue section having a leading edge underlying a portion of the vamp section of the shoe, a trailing edge which merges into said liner section, and medial and lateral sides, said tongue section being cantilevered under the lacing area of the quarter section and being rigidly affixed to the outer shell portion only at a rearward portion of one of its medial and lateral side regions and a portion of its trailing edge, but is not directly affixed to the shoe at other points on its medial and lateral side regions.

5. The combined shoe tongue and shoe liner for a shoe of claim 4, further comprising an elastic panel of material having upper and lower regions, and which is attached at its upper region to the other of the medial and lateral side of the tongue portion which is not rigidly attached to the shoe at one of its medial and lateral side regions and a portion of its trailing edge, and which is attached at its lower region in the vicinity of the sole of the shoe, said elastic panel tending to conform the tongue section to wearer's foot.

6. The combined shoe tongue and shoe liner for a shoe of claim 4, wherein said leading edge of said tongue section is rigidly attached to the vamp of the shoe.

7. A shoe comprising:

an outer shell portion having an exterior surface and an interior surface, said outer shell portion having a vamp section, a quarter section, and a counter section, and a lacing area generally formed in the longitudinal region of the quarter section of the shoe;

a sole attached to a lower portion of said outer shell portion; and a tongue portion which generally underlies the lacing area of the shoe, said tongue portion having a leading edge which is overlapped by a portion of the vamp section, a trailing edge which lies rearwardly of the quarter section, and medial and lateral side regions, wherein said tongue portion is directly attached, at a rearward portion of one of its medial and lateral side regions and a portion of its trailing edge, to the interior surface of the outer shell portion at one of the medial and lateral sides of (a) the rearwardly lying region of the quarter section, (b) the counter section, and (c) both the rearwardly lying region of the quarter section and counter section, and wherein other areas of the tongue portion are not directly attached to the shoe.

8. The shoe of claim 7, wherein said tongue portion comprises at least a portion of a liner which lines at least a portion of the interior surface of the outer shell portion.

9. The shoe of claim 7, further comprising an elastic panel of material with an upper region and a lower region, said elastic panel of material being attached at its upper region to one of the medial or lateral sides of the tongue portion which is not directly attached at a rearward portion of one of its medial and lateral side regions and a portion of its trailing edge to the interior surface of the outer shell portion of the shoe, said elastic panel of material being attached at its lower region in the vicinity of the sole.

10. A shoe comprising:

an outer shell portion having an exterior surface and an interior surface, said outer shell portion having a vamp section, a quarter section having a lacing area, and a counter section;

a sole attached to a lower portion of said outer shell portion; and a tongue portion which comprises an extension of a liner which at least partially lines the interior surface of said outer shell portion, said tongue portion having a leading edge which is overlapped by a portion of the vamp section, a trailing edge which lies nearer to the counter section, and medial and lateral side regions, wherein said tongue portion underlies the lacing area of the quarter section and its trailing edge merges into said liner only at a rearward portion of one of its medial and lateral side regions, and is directly and rigidly affixed to the outer shell portion at one of the medial and lateral sides of (a) the rearwardly lying region of the quarter section, (b) the counter section, and (c) both the rearwardly lying region of the quarter section and the counter section, and wherein other areas of the tongue portion are not directly attached to the shoe.

11. The shoe of claim 10, wherein said shoe further comprises an elasticized panel of material with an upper and lower region, said elasticized panel being attached at its upper region to the medial or lateral region of a tongue portion which is not attached near the shoe sole, said elasticized panel being attached at its lower region in the vicinity of the sole.

12. The shoe of claim 11, wherein said leading edge of the tongue portion is unattached to the vamp section.

13. A shoe comprising:

an outer shell portion having an exterior surface and an interior surface, said outer shell portion having a vamp section, a quarter section having a lacing area, and a counter section;

a sole attached to a lower portion of said outer shell portion; and a tongue portion which comprises an extension of a liner which at least partially lines the interior surface of said outer shell portion, said tongue portion having a leading edge which is overlapped by a portion of the vamp section and which is attached to the vamp section, a trailing edge which lies nearer to the counter section, and medial and lateral side regions, wherein said tongue portion underlies the lacing area of the quarter section and its trailing edge merges into said liner only at a rearward portion of one of its medial and lateral side regions, and is directly and rigidly affixed to the outer shell portion at one of the medial and lateral sides of (a) the rearwardly lying region of the quarter section, (b) the counter section, and (c) both the rearwardly lying region of the quarter section and the counter section, and wherein other areas of the tongue portion are not directly attached to the shoe.

14. A shoe comprising:

an outer shell portion having an exterior surface and an interior surface, said outer shell portion having a vamp section, a quarter section having a lacing area, and a counter section;

a sole attached to a lower portion of said outer shell portion;

a tongue portion which comprises an extension of a liner which at least partially lines the interior surface of said outer shell portion, said tongue portion having a leading edge which is overlapped by a portion of the vamp section, a trailing edge which lies nearer to the counter section, and medial and lateral side region, wherein said tongue portion underlies the lacing area of the quarter section and its trailing edge merges into said liner only at a rearward portion of one of its medial and lateral side regions, and is rigidly affixed to the outer shell portion at one of the medial and lateral sides of (a) the rearwardly lying region of the quarter section, (b) the counter section, and (c) both the rearwardly lying region of the quarter section and the counter section; and an elasticized panel of material with an upper and lower region; wherein said elasticized panel is attached at its upper region to the medial or lateral side region of the tongue portion which is not directly affixed to the interior surface of the shoe, and is attached in the vicinity of the sole at its lower region.

15. A shoe comprising:

an outer shell portion having an exterior surface and an interior surface, said outer shell portion having a vamp section, a quarter section having a lacing area, and a counter section;

a sole attached to a lower portion of said outer shell portion; and a tongue portion which comprises an extension of a liner which at least partially lines the interior surface of said outer shell portion, said tongue portion having a leading edge which is overlapped by and attached to a portion of the vamp section, a trailing edge which lies nearer to the counter section, and medial and lateral side regions, wherein said tongue portion underlies the lacing area of the quarter section and said shoe tongue merges into said liner only at a rearward portion of one of its medial and lateral side regions and a portion of its trailing edge, and is directly affixed to the outer shell portion at one of the medial and lateral sides of predominantly the counter section, and wherein other areas of the tongue portion are not directly attached to the shoe.

16. A shoe comprising:

an outer shell portion having an exterior surface and an interior surface, said outer shell portion having a vamp section, a quarter section having a lacing area, and a counter section;

a sole attached to a lower portion of said outer shell portion;

an elasticized panel of material with an upper and lower region; and a tongue portion which comprises an extension of a liner which at least partially lines the interior surface of said outer shell portion, said tongue portion having a leading edge which is overlapped by and attached to a portion of the vamp section, a trailing edge which lies nearer to the counter section, and medial and lateral side regions, wherein said tongue portion underlies the lacing area of the quarter section and said shoe tongue merges into said liner only at a rearward portion of one of its medial and lateral side regions and a portion of its trailing edge, and is directly affixed to the shoe at one of the medial and lateral sides of predominantly the counter section, and wherein said elasticized panel is attached at its upper region to the medial or lateral side region of the tongue portion which is not rigidly affixed to the interior surface of the shoe, and is attached in the vicinity of the sole at its lower region, and wherein other area of the tongue portion are not directly attached to the shoe.

* * * * *